US008601729B2

(12) United States Patent
Pitcher et al.

(10) Patent No.: US 8,601,729 B2
(45) Date of Patent: Dec. 10, 2013

(54) MODULAR PANEL DISPLAY ARRANGEMENT

(75) Inventors: David E. Pitcher, Swampscott, MA (US); Thomas P. Burrous, Haverhill, MA (US); Rebecca C. Suciu, Lynn, MA (US); Alan L. Stenfors, Scituate, MA (US); Sidney Rose, Marblehead, MA (US)

(73) Assignee: Rose Displays, Ltd., Salem, MA (US)

( * ) Notice: Subject to any disclaimer, the term of this patent is extended or adjusted under 35 U.S.C. 154(b) by 232 days.

(21) Appl. No.: 12/931,045

(22) Filed: Jan. 21, 2011

(65) Prior Publication Data

US 2012/0186119 A1 Jul. 26, 2012

(51) Int. Cl.
*A47G 5/00* (2006.01)
*G09F 7/00* (2006.01)

(52) U.S. Cl.
USPC ..... 40/605; 160/135; 160/351

(58) Field of Classification Search
USPC ..... 40/605; 160/135, 351
See application file for complete search history.

(56) References Cited

U.S. PATENT DOCUMENTS

| | | | | | |
|---|---|---|---|---|---|
| 3,037,593 | A * | 6/1962 | Webster | 52/476 |
| 3,132,432 | A * | 5/1964 | Yee | 40/730 |
| 3,605,851 | A * | 9/1971 | Miles et al. | 160/135 |
| 5,313,751 | A * | 5/1994 | Wittler | 52/238.1 |
| 5,491,943 | A * | 2/1996 | Vondrejs et al. | 52/239 |
| 6,536,147 | B1 * | 3/2003 | Funk et al. | 40/605 |
| 2002/0092626 | A1 * | 7/2002 | Beall | 160/135 |

* cited by examiner

*Primary Examiner* — Casandra Davis
(74) *Attorney, Agent, or Firm* — Don Halgren

(57) ABSTRACT

A modular panel display unit assembly, comprising: an elongated upper plate and an elongated lower plate, both arranged parallel to one another and supported by a first side rail and a second side rail secured therebetween, wherein a backer board is capturably received between the upper plate and the lower plate, and wherein one or more modular display panel units may be connected end to end together, and wherein a display panel is removably attached to a backer board secured between the upper plate and the lower plate thereof.

12 Claims, 11 Drawing Sheets

MODULAR PANEL DISPLAY ARRANGEMENT

BACKGROUND OF THE INVENTION

1. Field of the Invention

This invention relates to modular assemblies and more particularly to components which may be arranged to assemble any of a wide variety of curved or straight walled structures for supporting a display panel on the sides thereof.

2. Prior Art

The commercial retail industry requires quite a few signs to maintain their business. The more conspicuous these signs are, the higher the probability that customers will pay attention to them and to make their purchases accordingly. These signs however often need to be changed on a daily basis.

A need for such signage therefore is that their displaying arrangements need to be easily changed and that the supporting structure must not be complicated nor difficult to change, themselves. Such a structure is found in U.S. Pat. No. 7,562,849, however, it does not address the need for "add-on" units to permit connecting itself to an adjacent display.

It is therefore an object of the present invention, to overcome the disadvantages of the prior art.

It is a further object of the present invention, to provide an attractive, conspicuous, 3-dimensional structure which is easy to assemble, easy to adapt to its surroundings, and provides ease of change of graphics supported thereby.

It is yet a still further object of the present invention, to provide a 3-dimensional structure whose shipment may be made as simple as possible and to its adaptability to change, to permit multiple configurations is made easily.

BRIEF SUMMARY OF THE INVENTION

The present invention comprises a modular panel display arrangement assembled from connectable components to permit a 3-dimensional presentation of a commercial display. The panel display arrangement may include one or more individually assembled and connected modular units.

Each modular unit may be comprised of an elongated upper plate and an elongated lower plate held in a spaced apart parallel relationship by a first side rail and a second side rail. One or more elongated middle rails be located between the first side rail and the second side rail, and may be securably attached to the elongated upper plate and the elongated lower plate. Each modular unit may have a first end rail at a first end thereof and a second end rail at a second end a thereof, or that second end rail may be disposed at the second end of a plurality of modular units connected together.

Each modular unit may be free-standing by itself, or connected to one or more adjacent modular units in a straight line, a curved or sinusoidal line, or in a circular, oval or box shape, depending upon the desired assembly, and depending upon the curve or straightness of the upper and the lower plates for the particular individual units.

Each elongated upper plate and each elongated lower plate for a particular module unit are identical to one another. The elongated plate has a pair of channels extending adjacent each elongated side thereof so as to form a receiving track for a backer panel to be placed therein. Each elongated upper plate and each elongated lower plate have two or more pairs of spaced apart holes for the receipt and passage of securement bolts therethrough. The pairs of spaced apart holes in the upper plate and in the lower plate are arranged to be in alignment with the first side rail, the middle rail and the second side rail respectively, for the secure assembly of the upper plate and the lower plate to those rails.

The first elongated side rail comprises a central, generally "U" shaped channel having a backer panel edge receiving track disposed on each side thereof. Each receiving track comprises an "L" shaped flange, in cross section. The central "U"-shaped channel of the first side rail has a pair of parallel side arms with a "C" shaped channel at its distal edge thereof. A pair of second "C" shaped channels are arranged on the opposite side of the central U-shaped channel, having an open slot directed toward one another, for sliding connection to a first outside end rail thereagainst, or to a further modular unit's second elongated side rail, for a multiple unit assembly, as needed.

The second elongated side rail comprises a central, generally "U" shaped channel having a backer panel edge receiving track disposed on each side thereof. Each receiving track comprises an "L" shaped flange, in cross section. The central "U"-shaped channel of the second or inner side rail has a pair of parallel side arms with a "C" shaped channel at its distal edge thereof. A pair of second "C" shaped channels are arranged on the opposite side of the central U-shaped channel, having an open slot directed away from one another, for sliding connection to a second outside end rail or to a further modular unit's first elongated side rail, for a multiple unit assembly, as needed.

The middle rail is of generally "I" shape in cross section, having a support web extending between a pair of flat members. The juncture of the support web and each flat member consists of a generally "C" shaped channel disposed therebetween. The "C" shaped channels at each end of the elongated middle rail provides an opening for a securement bolt to be received therein, through an elongated upper plate or an elongated lower plate respectively.

The elongated first end rail is of generally "D"-shape in cross section, having a generally semicircular outer housing connected to an elongated planar inner side. A pair of fingers extended radially inwardly from the semicircular housing, each finger having a generally "C" shaped channel arranged distally thereon. A pair of second "C" shaped channels are arranged on the back side of the elongated planar side, each having an open slot facing away from one another, for sliding connection to an elongated side rail.

The elongated second end rail is of generally "D"-shape in cross section, having a generally semicircular outer housing connected to an elongated planar inner side. A pair of fingers extended radially inwardly from the semicircular housing, each finger having a generally "C" shaped channel arranged distally thereon. A pair of second "C" shaped channels are arranged on the back side of the elongated planar side, each having an open slot facing toward one another, for sliding connection to an elongated second side rail, at the end of a modular unit or at the end of a chain of modular units.

A backer panel is captured within the channels of the upper and the lower plates, and within the edge receiving tracks of the first and the second side rails.

An end cap is arranged to be secured to each respective end of the first end rail and the second end rail by securement bolts attached to the respective "C" shaped channels extending radially inwardly from their respective semicircular outer housings.

After a modular unit is assembled, or a plurality of modular units are connected to one another, with their respective backer panels inserted into their respective receiving tracks, a display may be attached to the outer side of those backer panels magnetically, electrostatically, with an appropriate adhesive or by other attachment means.

The invention thus comprises a modular panel display unit assembly, comprising: an elongated upper plate and an elongated lower plate, arranged parallel to one another and supported by a first side rail and a second side rail secured therebetween; a backer board capturably received between the upper plate and the lower plate; an end rail may in one embodiment be slidably secured to a side rail at an end of the unit, and wherein a display panel is removably attached to a backer board secured between the upper plate and the lower plate for a free standable modular display thereof. The elongated upper plate and the elongated lower plate for each particular unit are preferably commonly curvilinear or commonly straight, as the case may be. The unit assembly may comprise at least two contiguous, joined individual modular units. The upper elongated plate and a lower elongated plate of a second modular unit in the assembly may be of linear shape. The upper plate and the lower plate each have a display panel supporting channel extending along an exterior edge thereof. The first side rail and the second side rail each have bolt-receiving channels arranged at each end thereof, for receipt of a securement bolt through the upper plate and the lower plate respectively. The bolt receiving channels in the respective first side rail and the second side rail are also arranged to slidably engage one another when joining several modular units together. The first side rail and the second side rail each preferably have a pair of inwardly directed flanges thereon. The inwardly directed flanges on the first side rail and the second side rail each preferably have a distal edge with a bolt receiving channel arranged thereon. An intermediate middle rail is may be secured between the first side rail and the second side rail in a display unit.

The invention also comprises a modular panel display unit assembly of closed perimeter shape, comprising: a plurality of curved elongated upper plates and a plurality of curved elongated lower plates, the upper and lower plates arranged parallel to one another; wherein each vertical pair of upper plate and lower plate are supported by a first side rail and a second side rail secured therebetween, and wherein the upper plates are connected to one another in a curved arrangement, and the lower plates are connected to one another in a corresponding curved arrangement, to form the closed perimeter shaped thereby. A backer board is preferably capturably received between at least one vertically adjacent upper plate and one lower plate. An upper plate and lower plate of any particular modular unit may be of linear configuration. A display panel may be removably attached to a backer board secured between the upper plate and the lower plate for a free standable modular display thereof.

The invention also includes a method of displaying a display panel comprising: securing an upper plate and a lower plate together in a parallel spaced-apart configuration by a first side rail and a second side rail, to form a first modular display unit, the upper plate and the lower plate each having a display panel support channel along an exterior longitudinally directed side thereof; placing a backer panel in the display panel support channel in the upper plate and the lower plate of the modular display unit and within the edge retaining tracks of the side rails; and attaching a display panel onto the backer panel supported by the modular display unit. The upper plate and the lower plate of the first modular display unit may be commonly curvilinear. A further modular display unit may be added to the first modular display unit by slidably engaging a second side rail of the first modular display unit to a first side rail of the further modular display unit. The further modular display unit may form a sinusoidal arrangement of display units with the first modular display unit. The further modular display unit attached to the first modular display unit may form a closed perimeter assembly of modular display units.

BRIEF DESCRIPTION OF THE DRAWINGS

The objects and advantages of the present invention will become more apparent when viewed in conjunction with the following drawings in which.

DETAILED DESCRIPTION OF THE PRESENT INVENTION

Figure 1:
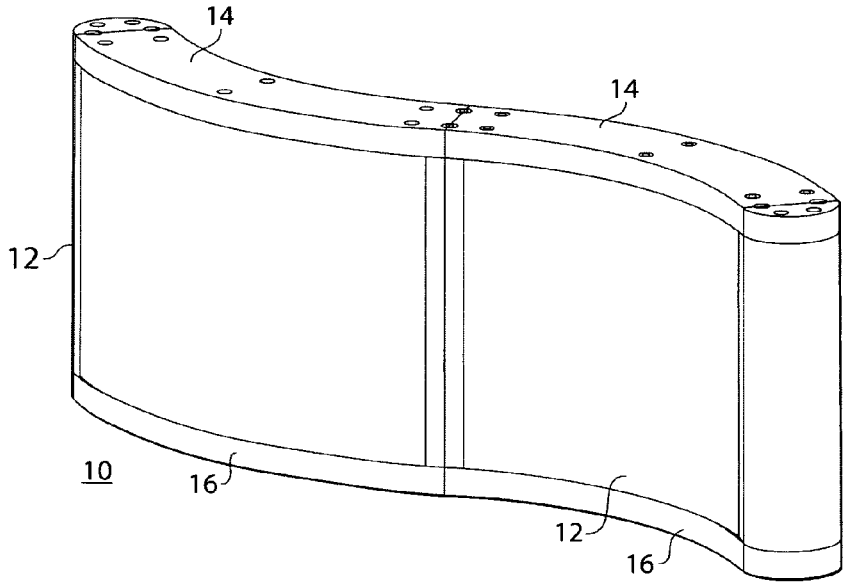
FIG. 1 is a perspective view of a pair of modular units connected together in a curvilinear fashion.

The present invention comprises a modular panel display arrangement 10 assembled from a plurality of connectable components to permit a 3-dimensional preferably free-standing presentation of a commercial display, as represented in FIG. 1. The panel display arrangement 10 may include one or more individually assembled and connected modular units 12, as represented in FIGS. 1, 5, 9, 11 through 17.

Figure 5:
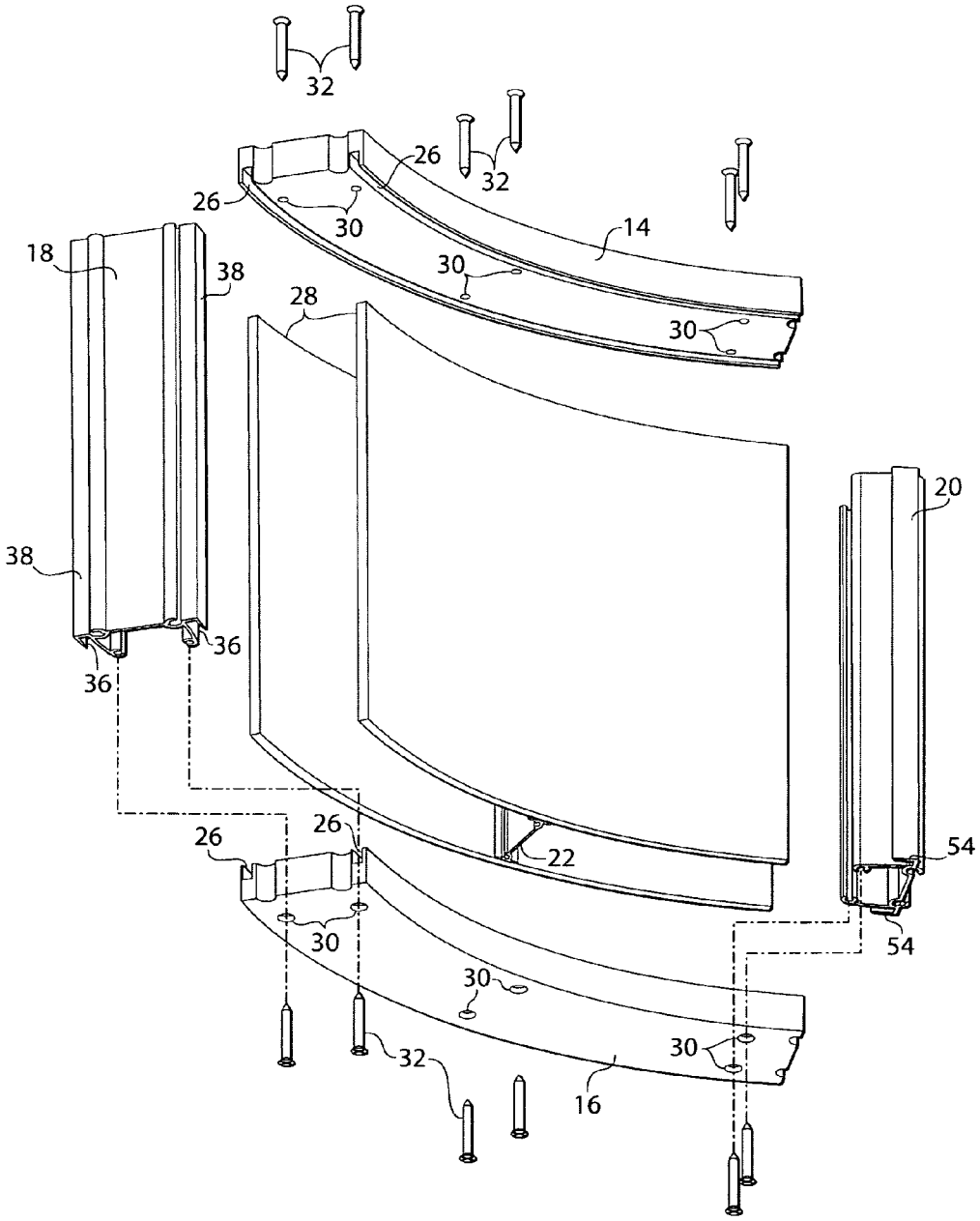
FIG. 5 is an exploded view all of a modular unit assembly, without the end rails thereattached.
Figure 6:
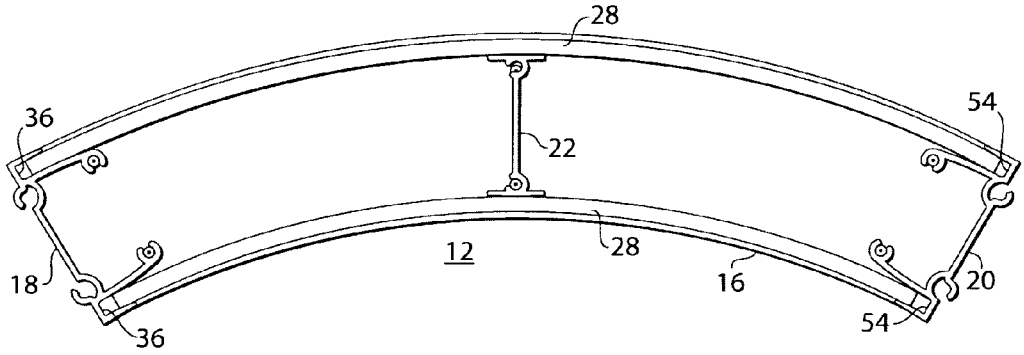
FIG. 6 is a plan view of an elongated first side rail, a middle rail and an elongated second side rail secured to an elongated, curved lower plate.
Figure 10:
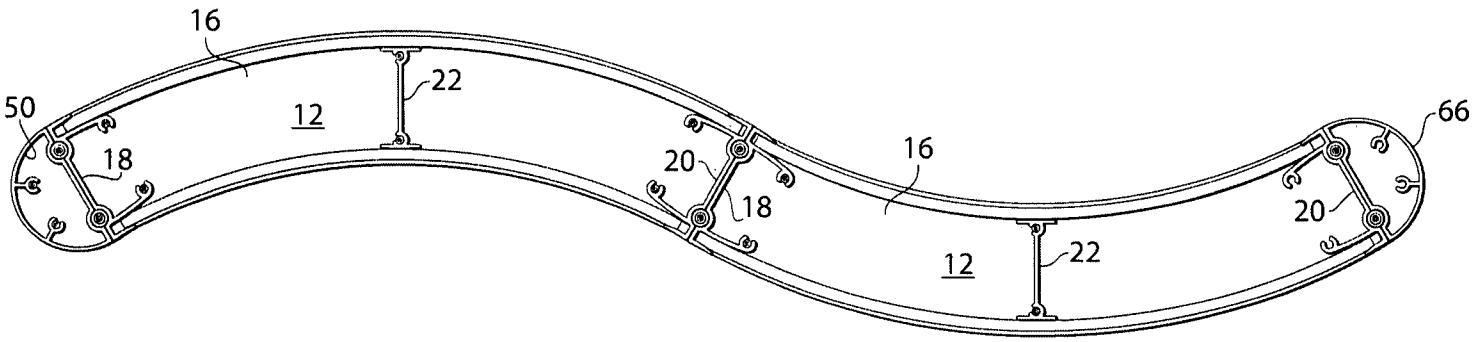
FIG. 10 is a plan view showing a pair of modular units without an elongated upper plate thereon.

Each modular unit 12 may be comprised of an elongated upper plate 14 and an elongated lower plate 16 held in a spaced apart parallel relationship by a first side rail 18 and a second side rail 20, as may be seen in FIGS. 5, 6 and 10. An elongated middle rail 22, represented in FIG. 3, may be securably attached between the elongated upper plate 14 and the elongated lower plate 16, as represented in FIGS. 5, 6 and 10. Each modular unit 12 may have a first end or side rail 18 at a first end thereof and a second end or side rail 20 at a second end thereof as represented in FIGS. 5 and 6, or that second end or side rail 20 may be disposed at the second end of a plurality of modular units 12 connected together, as represented in FIG. 10.

Figure 13:
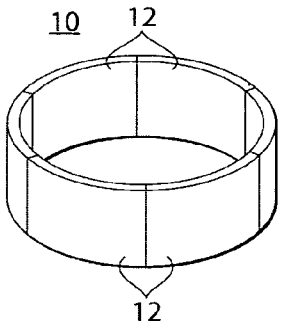
FIG. 13 is a perspective view of plurality of curved modular units connected together to form a circle.
Figure 14:
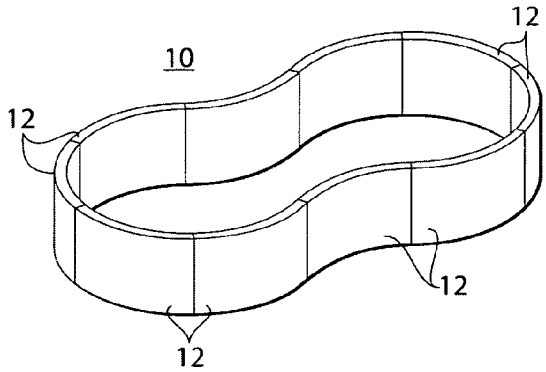
FIG. 14 is a perspective view of a plurality of curved modular units connected together to form a shaped figure "8"
Figure 15:
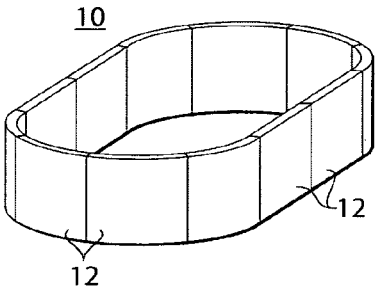
FIG. 15 is a perspective view of a plurality of curved and straight modular units connected together to form a "rectangular" structure.
Figure 16:
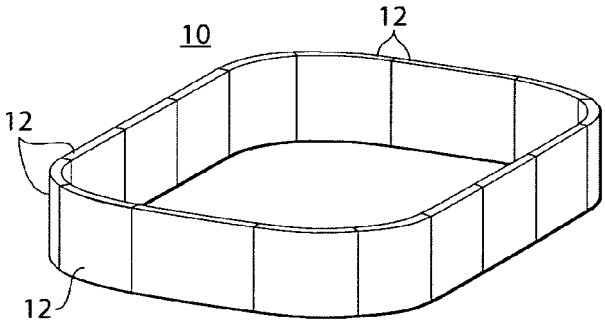
FIG. 16 is a perspective view of a plurality of curved and straight modular units connected together to form a "square like" structure.
Figure 17:
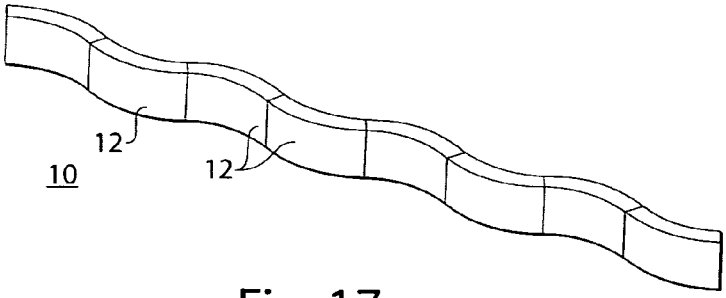
FIG. 17 is a perspective view of a plurality of curved modular units connected together to form a wavy or sinusoidal shaped structure.

Each modular unit 12 may be free-standing by itself, or connected to one or more adjacent modular units 12 in a straight line as represented in portions of FIGS. 15 and 16, a curved or sinusoidal line as represented in FIGS. 14 and 17, or defining a "closed perimeter" shape, such as in a circular shape as represented in FIG. 13, or in an oval or box-like shape, as represented in FIGS. 14, 15 and 16, depending upon the desired assembly, and depending upon the curve or straightness of the upper and the lower plates 14 and 16 for the particular individual units.

Each elongated upper plate 14 and each elongated lower plate 16 for a particular modular unit 12 are identical to one another, as may be visualized in FIG. 5. Each elongated plate 14 and 16 has a pair of channels 26 extending adjacent each elongated longitudinally directed side thereof so as to form a receiving track for a backer panel 28 to be placed therein, as represented in an exploded view in FIG. 5, and in plan views shown in FIGS. 6 and 10. Each elongated upper plate 14 and each elongated lower plate 16 have two or more pairs of spaced apart holes 30, as best represented in FIG. 5 for the receipt and passage of securement bolts 32 therethrough. The pairs of spaced apart holes 30 in the upper plate 14 and in the lower plate 16 are arranged to be in alignment with the first side rail 18, the middle rail 22 and the second side rail 20 respectively, as may be visualized in FIG. 5, for the secure assembly of the upper plate 14 and the lower plate 16 to those rails 18, 22 and 20.

Figure 2:
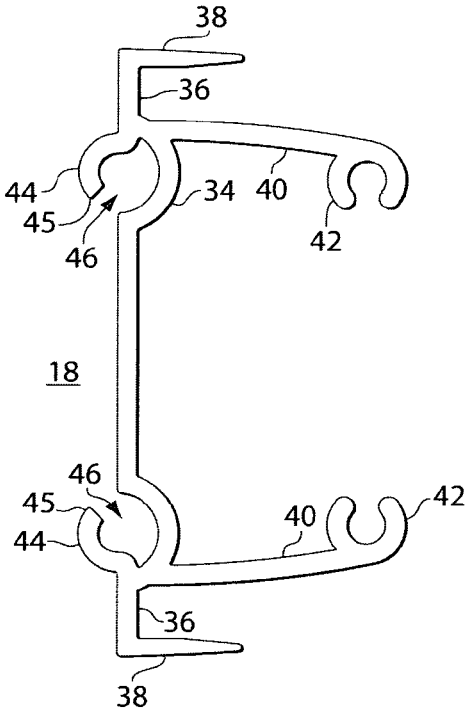
FIG. 2 is an end view of an elongated first side rail.

The first elongated side rail 18, shown in an end view in FIG. 2, comprises a central, generally "U" shaped channel 34 having a backer panel edge receiving track 36 disposed on each side thereof. Each receiving track 36 comprises an "L" shaped flange 38, in cross section. The central "U"-shaped channel 34 of the first side rail 18 has a pair of parallel side arms 40 each with a "C" shaped channel 42 at its distal edge thereof, as shown in FIG. 2. A pair of second "C" shaped channels 44 are arranged on the opposite side of the central U-shaped channel 34, having an open slot 46 directed toward one another, for a sliding connection to a first outside end rail 50, (shown in FIG. 7), thereagainst, or to a second elongated side rail 20 of a further modular unit 12, for a multiple unit assembly, as needed.

Figure 4:
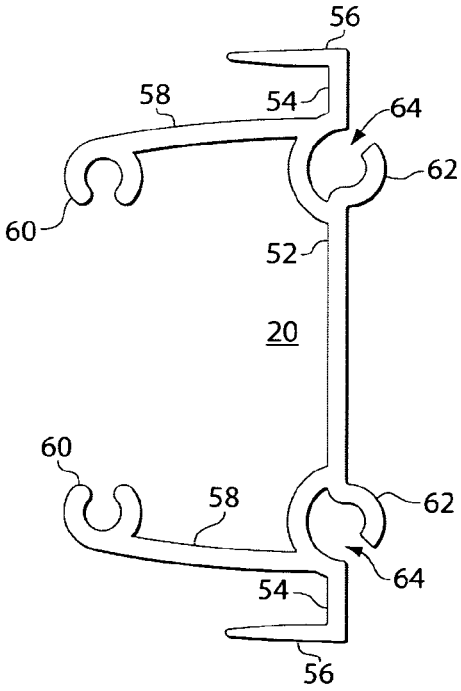
FIG. 4 is in end view of an elongated second side rail.

The second elongated side rail 20 comprises a central, generally "U" shaped channel 52 having a backer panel edge receiving track 54 disposed on each side thereof, as shown in FIG. 4. Each receiving track 54 comprises an "L" shaped flange 56, in cross section. The central "U"-shaped channel 52 of the second side rail 20 has a pair of parallel side arms 58 with a "C" shaped channel 60 at its distal edge thereof, as shown in FIG. 4. A pair of second "C" shaped channels 62 are arranged on the opposite side of the central U-shaped channel 52, having an open slot 64 directed away from one another, as shown in FIG. 4, for an interengagable sliding connection to a second outside end rail 66, as shown in FIG. 8, or to a further modular unit's first elongated outer side rail 18, as represented in FIG. 10, to permit a sideways expansion, to create a multiple unit assembly, as needed.

Figure 3:
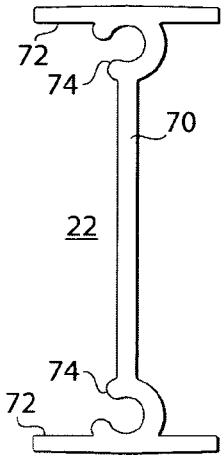
FIG. 3 is an end view of an elongated middle rail.

The elongated middle rail 22 is of generally "I" shape in cross section as shown in FIGS. 3, 6 and 10, having a support web 70 extending between a pair of flat members 72. The juncture of the support web 70 and each flat member 72 consists of a generally "C" shaped channel 74 disposed therebetween, as is best represented in FIG. 3. The "C" shaped channels 74 at each end of the elongated middle rail 22 provides an opening for a securement bolt 32 to be received therein, through an elongated upper plate 14 or an elongated lower plate 16, respectively, as may be seen in FIGS. 5, 6, 9 and 10.

Figure 7:
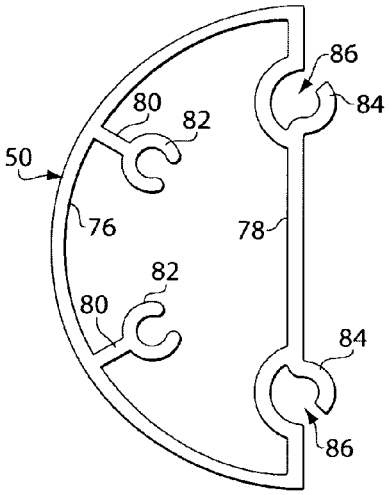
FIG. 7 is an end view of a first end rail.

The elongated first end rail 50 is of generally "D"-shape in cross section, as represented in FIG. 7, having a generally semicircular outer housing 76 connected to an elongated planar inner side 78. A pair of fingers 80 extended radially inwardly from the semicircular housing 76, as shown in FIGS. 7 and 10, each finger 80 having a generally "C" shaped channel 82 arranged distally thereon. A pair of second "C" shaped channels 84 are arranged on the back side of the elongated planar side 78, as shown in FIG. 7, each channel 78 having an open slot 86 facing away from one another, as shown in FIGS. 7 and 10, for sliding connection to an elongated outer side rail 18, as shown in FIGS. 9 and 10.

Figure 8:
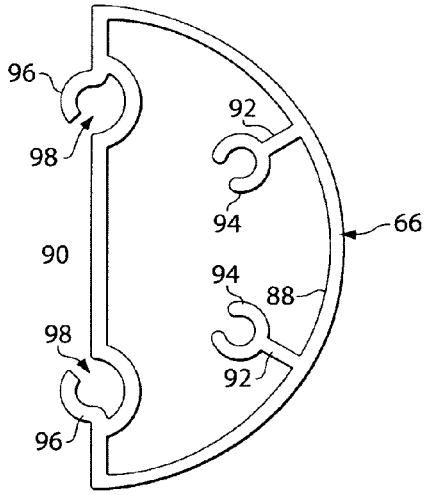
FIG. 8 is an end view of a second end rail.

The elongated second end rail 66 is also of generally "D"-shape in cross section, as represented in FIG. 8, having a generally semicircular outer housing 88 connected to an elongated planar inner side 90. A pair of fingers 92 extended radially inwardly from the semicircular housing 88, each finger having a generally "C" shaped channel 94 arranged distally thereon, as is shown in FIG. 8. A pair of second "C" shaped channels 96 are arranged on the back side of the elongated planar inner side 90, each channel 96 having an open slot 98 facing toward one another, for sliding connection to an elongated inner side rail 20, at the end of a modular unit 12 or at the end of a chain of modular units as represented in FIG. 10.

A backer panel 28 is captured in the channels 26 of the upper and lower plates 14 and 16, and in the edge receiving tracks 36 and 54 of the first and second side rail 18 and 20, respectively.

Figure 9:
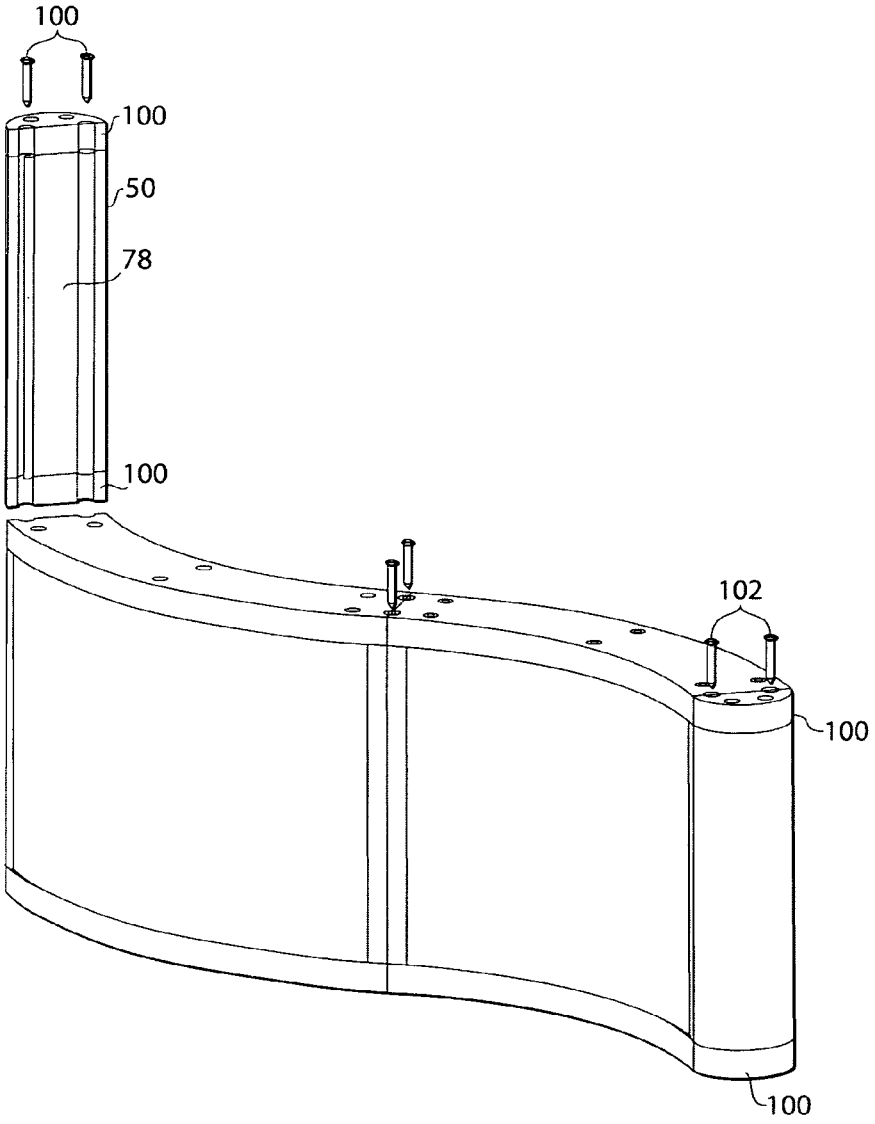
FIG. 9 is a view similar to FIG. 1 showing an end rail and an end cap in a stage of assembly.

As shown in FIG. 9, an end cap 100 is arranged to be secured to each respective end of the first end rail 50 and the second end rail 66 by securement bolts 102 attached to the respective "C" shaped channels 82 and 94, extending radially inwardly from their respective semicircular outer housings 76 and 88.

Figure 11:
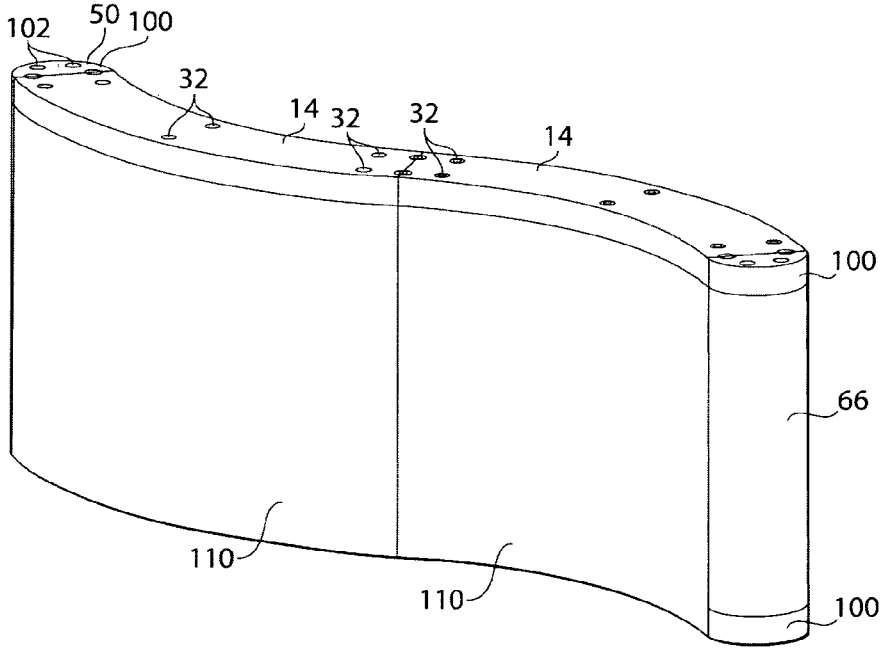
FIG. 11 is a view similar to FIG. 1, showing a pair of the module units assembled with a display graphic disposed on the sides thereof.
Figure 12:
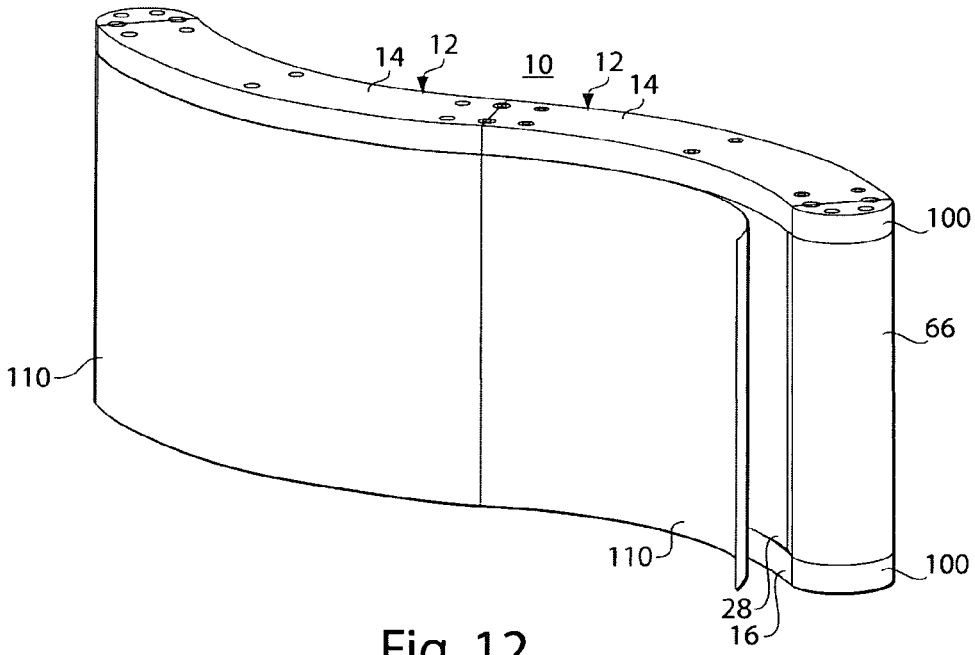
FIG. 12 is a view similar to FIG. 11, showing a graphic being changed.

After a modular unit 12 is assembled, wherein the lips 45 of the "C" shaped channels 44 are inserted into the slots 86 of the "C" shaped channels 84, shown in FIG. 7, or a plurality of modular units 12 are connected to one another, with the lips 45 of a first side rail 18 slid into the "C" shaped channel 62 of a second side rail 20, as represented in FIG. 10, with their respective backer panels 28 inserted into their respective receiving tracks 26, 36 and 54, as represented in FIG. 5, the bolts 102 being inserted into those channels 84, 44, 62 and 96, as variously represented in FIGS. 2, 4, 7, 8, 9 and 10, to secure multiple modular units 12 together and also to secure the first and second end rails 50 and 66 to the respective ends of an assembly 10, then a display panel 110 may be attached to the outer side of those backer panels 28, as shown in FIGS. 11 and 12, magnetically, electrostatically or with an appropriate adhesive or other proper attachment means.

We claim:

1. A modular panel display unit assembly, comprising:

an elongated upper plate and an elongated lower plate, arranged parallel to one another and supported by a first side rail and a second side rail secured therebetween, wherein the first side rail and the second side rail each have interengagable channels to permit sideways expansion of the assembly, and wherein the elongated upper and lower plates are of common curvilinear configuration to facilitate display unit assembly stability and promote display unit conspicuity;

a backer board capturably received between the upper plate and the lower plate wherein a display panel is removably attached to a backer board secured between the upper plate and the lower plate for a free standable modular display thereof; and wherein an intermediate middle rail is secured to the upper and lower plates between the first side rail and the second side rail in a display unit.

2. The modular panel display unit assembly as recited in claim 1, wherein the elongated upper plate and the elongated lower plate for each unit are commonly shaped.

3. The modular panel display unit assembly as recited in claim 1, wherein the unit assembly comprises at least two contiguous, joined, sideways expanded assembly of individual modular units.

4. The modular panel display unit assembly as recited in claim 3, wherein an upper elongated plate and a lower elongated plate of a second modular unit in the assembly are of linear shape.

5. The modular panel display unit assembly as recited in claim 1, wherein the upper plate and the lower plate each have a channel extending along an exterior edge thereof.

6. A modular panel display unit assembly, comprising:

an elongated upper plate and an elongated lower plate, arranged parallel to one another and supported by a first side rail and a second side rail secured therebetween, wherein the first side rail and the second side rail each have interengagable channels to permit sideways expansion of the assembly, and wherein the elongated upper and lower plates are of common curvilinear configuration to facilitate display unit assembly stability and promote display unit conspicuity;

a backer board capturably received between the upper plate and the lower plate wherein a display panel is removably attached to a backer board secured between the upper plate and the lower plate for a free standable modular display thereof; and wherein the first side rail and the second side rail each have bolt-receiving channels arranged at each end thereof, for receipt of a securement bolt through the upper plate and the lower plate respectively.

7. The modular panel display unit assembly as recited in claim 6, wherein the bolt receiving channels in the respective first side rail and the second side rail are arranged to slidably engage one another.

8. The modular panel display unit assembly as recited in claim 6, wherein first side rail and the second side rail each have a pair of inwardly directed flanges thereon.

9. The modular panel display unit assembly as recited in claim 8, wherein the inwardly directed flanges on the first side rail and the second side rail each have a distal edge with a bolt receiving channel arranged thereon.

10. The modular panel display unit assembly of closed perimeter shape, as recited in claim 6, wherein at least one pair of upper plates and lower plate are of linear configuration.

11. The modular panel display unit assembly of closed perimeter shape, as recited in claim 6, wherein a display panel is removably attached to a backer board secured between the upper plate and the lower plate for a free standable modular display thereof.

12. A modular panel display unit assembly, comprising:

an elongated upper plate and an elongated lower plate, arranged parallel to one another and supported by a first side rail and a second side rail secured therebetween, wherein the first side rail and the second side rail each have interengagable channels to permit sideways expansion of the assembly, and wherein the elongated upper and lower plates are of common curvilinear configuration to facilitate display unit assembly stability and promote display unit conspicuity;

a backer board capturably received between the upper plate and the lower plate wherein a display panel is removably attached to a backer board secured between the upper plate and the lower plate for a free standable modular display thereof, and wherein the first side rail and the second side rail each have bolt-receiving channels arranged at each end thereof, for receipt of a securement bolt through the upper plate and the lower plate respectively, and wherein first side rail and the second side rail each have a pair of inwardly directed flanges thereon, and wherein the inwardly directed flanges on the first side rail and the second side rail each have a distal edge with a bolt receiving channel arranged thereon.

* * * * *